United States Patent [19]

Schoener

[11] 4,433,512

[45] Feb. 28, 1984

[54] REINFORCED GUTTER HANGER SUPPORTING BAR

[76] Inventor: Harry E. Schoener, 161 Island Pkwy., Island Park, N.Y. 11558

[21] Appl. No.: 361,445

[22] Filed: Mar. 24, 1982

[51] Int. Cl.[3] ..... E04D 13/06

[52] U.S. Cl. ..... 52/11; 248/48.1

[58] Field of Search ..... 52/11, 12, 13, 14, 15, 52/16; 248/48.1, 48.2

[56] References Cited

U.S. PATENT DOCUMENTS

| | | | |
|---|---|---|---|
| 142,016 | 8/1873 | Hammond | 248/48.1 |
| 1,017,174 | 2/1912 | Sander et al. | 248/48.1 |
| 1,635,871 | 7/1927 | Wilson | 248/48.1 |
| 3,060,638 | 10/1962 | Bender | 52/11 |
| 3,915,418 | 10/1975 | D'Amato | 52/11 X |

*Primary Examiner*—John E. Murtagh
*Assistant Examiner*—Kathryn L. Ford
*Attorney, Agent, or Firm*—Duffield & Lehrer

[57] ABSTRACT

A new reinforced gutter-hanger supporting bar designed to be incorporated with the conventional spike and tube gutter hanger and installed on any eaves-hung metal gutter. The supporting bar creates the novel LOCK-IN preferred embodiment of the invention, which LOCKS-IN the spike. This greatly improves the performance of the spike and tube hanger by permanently correcting the serious fault of these hangers—loosened and often lost spikes—as no other device known to the art does. No changes are made in the existing spike and tube hangers.

This new supporting bar is an inexpensive stamping, preferably fabricated from heavy sheet metal. Basically a one-piece metal strip it is shaped into three contiguous, yet different appearing sections.

First, a short flat end section of an embodiment of the invention which comprises two transverse, appropriately spaced deep score marks and two 3° bends, coinciding with an superimposed upon the score marks. They facilitate bending the bar by hand manipulation, over the spikehead and gutter flange to LOCK-IN the spike. One hole centered at the end of this section of the bar, allows the hanger spike to pass through during installation.

Second, a rib-reinforced, gutter-spanning section, supports the gutter at the flange and adds truss-like strength to resist stress on the spike and tube hanger and gutter.

Third, a long flat terminal section with nail holes centered along the axis, engages the roof to which it is secured by several nails. Only these nails and the existing spike of the hanger fasten the reinforced gutter-hanger supporting bar to the facia board and roof. This completes the novel LOCK-IN preferred embodiment of the invention.

3 Claims, 10 Drawing Figures

Fig.1
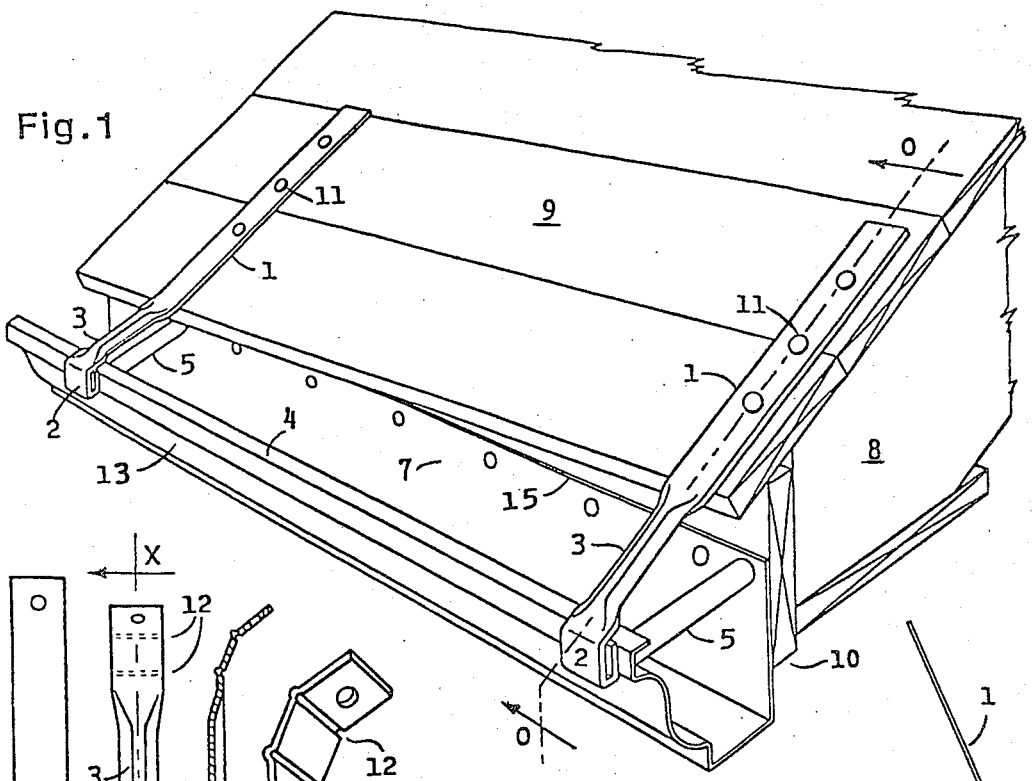
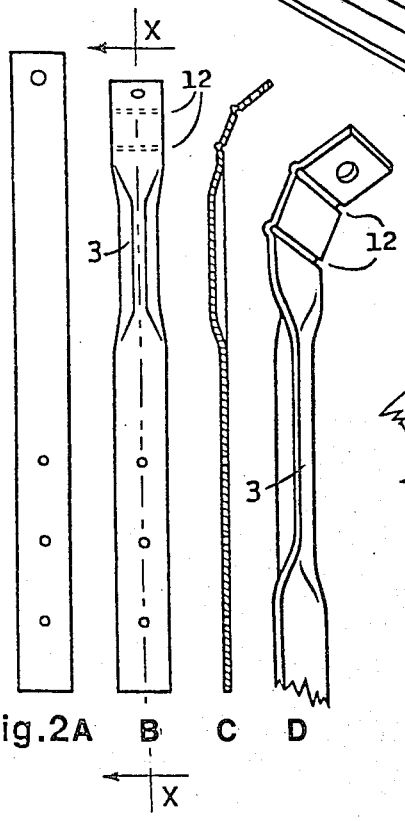
Fig.2A
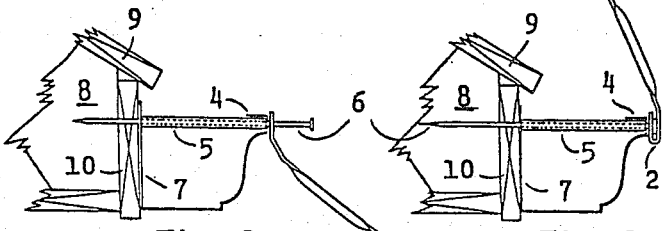
Fig.3A Fig.3B
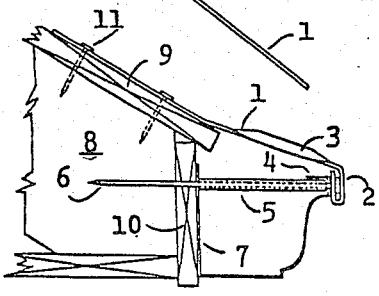
Fig.3C
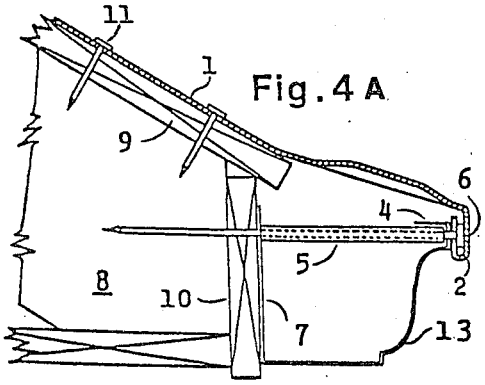
Fig.4A
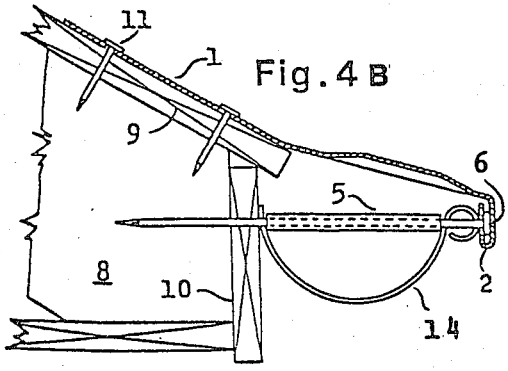
Fig.4B

REINFORCED GUTTER HANGER SUPPORTING BAR

TECHNICAL FIELD

This invention relates to a new superior reinforced gutter-hanger supporting bar with a novel LOCK-IN embodiment that greatly improves the performance of the conventional spike and tube gutter hangers. It is designed to be incorporated and installed therewith on any eaves-hung metal gutter, without making changes in the construction and installation of the existing spike and tube hanger.

BACKGROUND

The present invention concerns correcting the serious disadvantages of conventional spike and tube hangers—loosened and lost spikes. Although universally used by the thousands, these hangers fail to maintain the support, alignment and proper pitch of eaves-hung metal gutters. Seasonal maintenance is required, often with costly repairs and replacement.

This serious failure results from a design fault that does not LOCK-IN the spikes but allows them to loosen and even fall out, due to stress from heavy ice and snow loads, high wind vibrations, expansion and contraction, or careless use of ladders. Consequent sagging and displacement causes severe gutter damage with failure to conduct roof drainage water away from the structure.

Correcting this serious fault of spike and tube hangers called for a new, novel device designed to permanently LOCK-IN the spikes.

REFERENCES CITED

A search for other patented gutter attachments revealed that numerous patents for gutter attachments exist, but only a few were for use with conventional spike and tube hanger and not one of these corrected the serious fault of these hangers.

The following U.S. Pat. Nos. are representative:

| | | |
|---|---|---|
| 381,770 | C. C. Frederick | April 24, 1898 |
| 1,635,871 | J. C. Wilson | July 12, 1927 |
| 1,940,369 | J. Peal | Dec. 19, 1933 |
| 2,144,633 | E. W. Petersen | Jan. 24, 1939 |
| 2,895,694 | R. C. Graving et al | July 21, 1959 |
| 3,415,418 | N. J. D'Amato | Oct. 28, 1975 |

Only U.S. Pat. No. 1,635,871—July 1, 1927 (long expired and never marketed) appears to resemble the Applicant's invention. However, this patent has the following deficiencies:

1. Strap #9 is designed to engage only the inside of gutter flange #5. Therefore it cannot secure the spikehead and LOCK-IN the spike, to correct the serious fault of all spike and tube hangers—loosened and lost spikes.

2. The lower end of strap #9 is pre-bent at #11-#12. It can fit only inside the specific shape of gutter flange #5. So it cannot engage all the many sizes and shapes of gutter flanges on gutters from different manufacturers, without making prohibitive design and fabrication changes in each case.

3. Strap #9 has a rigid reinforcing rib that extends its full length up on to the roof. This rib makes strap #9 inflexible, it can engage and support the gutter only on the fixed level of the roof edge. No downward accommodation to the gutter pitch is possible. Poor gutter drainage results.

4. Strap #9 is held to the roof with only one nail #10, at the end. As this is a major point of support, multiple nailing should be provided.

The Applicant's invention in general, corrects these deficiencies of U.S. Pat. No. 1,635,871, as follows:

1. My invention corrects the fault of spike and tube hangers—loosened and lost spikes. The supporting bar with its novel score marks and bends, engages only the outside of the flange, can readily be bent over the spikehead, flange and gutter trough, then nailed to the roof to securely LOCK-IN the spike.

2. In my invention, because the supporting bar engages only the outside of the gutter flange, it is easily installed with the "½-Round" gutter or any manufacturer's varied size and shape eaves-hung metal gutters.

3. In this invention, the supporting bar adjusts automatically to gutter pitch during installation. The slight flexibility provided between the gutter-spanning and the roof-engaging sections of the bar, allows the automatic accommodation to the pitch. Good gutter drainage is assured.

4. This invention provides multiple nail holes along the axis of the roof-engaging section of the bar, not just one hole at the end. This major support section is fastened to the roof along its full length, by several nails.

SUMMARY OF THE INVENTION

This invention relates to a new reinforced gutter-hanger supporting bar of novel design for incorporation and installation with conventional spike and tube hangers used in conjunction with any eaves-hung metal gutter. Without making any changes in the construction and installation of the existing spike and tube hanger, the new supporting bar creates the novel LOCK-IN embodiment of the invention, which greatly improves hanger performance by permanent elimination of the serious fault of these hangers—loosened and lost spikes, with resultant gutter failure—as no other device known to the art does.

The invention also resides in the novel construction of the new reinforced supporting bar. A sturdy stamping, preferably from heavy sheet metal or strip stock, the fabrication is expeditious and economical of material, without waste. Basically, it comprises a flat one-piece metal strip with three contiguous, yet different appearing sections which encompass the novel LOCK-IN embodiment of the invention:

First: A short, flat end section modified by punch and die work, engages the outside of the gutter flange, the spike and spikehead of the spike and tube hanger. The novel components of this section, wherein the LOCK-IN embodiment of the invention reside, follow:

(a) Two transverse, appropriately spaced, deeply indented score marks.

(b) Two slight bends across the bar, each at 3° angle to the plane, coincide with and are superimposed upon each score mark.

(c) One hole centered near this end of the bar to allow the spike of the spike and tube hanger to pass through during installation of the bar. (These score marks and bends facilitate bending the bar by hand manipulation, over the spikehead and gutter flange to LOCK-IN the spike.)

Second: The rigid intermediate section is reinforced by a high longitudinal rib for additional strength. It spans the gutter trough, supports the gutter at front of gutter flange and provides truss-like support to resist stress upon the spike and tube hanger and the gutter.

Third: A longer, flat terminal section with nail holes appropriately spaced along the axis, engages the roof and is secured thereto.

Only several nails and the existing spike of the spike and tube hanger are required to secure the reinforced supporting bar incorporated with said hanger, to the roof and facia board.

Another aspect of the invention provides for the automatic adjustment of the reinforced supporting bar, to the pitch or fall of the gutter, during installation and incorporation with the spike and tube hanger.

The invention also resides in the novel installation procedure (later described in detail) which incorporates the new reinforced supporting bar with the spike and tube hanger, the gutter flange, and the spikehead. Only the existing spike of the spike and tube hanger and several nails secure the entire device to the facia board and roof, completing the novel LOCK-IN embodiment of the invention.

Although only incidental to the invention, the following advantages merit inclusion:

The high reinforcing rib of the gutter-spanning section of the bar effectively diverts dirty roof drainage water into the gutter trough, not over the gutter flange and down the gutter face, as a flat strip would. Stains and marks on the gutter and structure wall are prevented.

The roof-engaging section of the bar lays flat and is nailed flat on the roof sheathing. Therefore, the protective covering singles also lay flat for maximum effectiveness and good appearance.

OBJECTS OF THE INVENTION

An object of this invention is to provide a new reinforced gutter-hanger supporting bar for incorporation and installation with conventional spike and tube hangers in conjunction with any eaves-hung metal gutter, to greatly improve said hanger's performance.

It is the principal object of this invention to provide a new reinforced gutter hanger supporting bar designed to create the novel LOCK-IN embodiment of the invention, which permanently eliminates the serious fault of spike and tube hangers—loosened and lost spikes and resultant gutter failure—as no other known device does.

Another object of the invention is to provide a reinforced supporting bar to improve performance of the spike and tube hanger, that is of sturdy inexpensive construction. Basically, it is a one piece metal stamping, preferably from heavy sheet metal or strip stock. Fabrication is expeditious and economical of material.

An object of this invention is to provide a new reinforced supporting bar that improves the performance of the spike and tube hanger without making any changes in the construction and installation of the existing hanger.

Still another object of the invention is to provide a reinforced gutter-hanger supporting bar, which adjusts automatically to the pitch of the gutter during installation with the conventional spike and tube hanger in conjunction with any eaves-hung metal gutter.

An object of the invention is to provide a reinforced supporting bar for incorporation with spike and tube hangers, designed for use with the varied size and shapes of eaves-hung metal gutters from any manufacturer.

Still another practical object of the design of the invention provides a reinforced supporting bar of simple shape, which facilitates "nesting" for the compact stacking of numerous units for easy shipping and storage.

Also an object of the invention is to form, through incorporating the bar with the spike and tube hanger, a new three point gutter suspension, superior to any in use today.

A final object is to provide a reinforced supporting bar designed to require no extra nuts, bolts, screws or rivets during installation. Only the existing spike and several nails are used. Time and skill are materially reduced. Even one unskilled in the art, the do-it-yourselfer, can install it.

With the above objects and others evident, my invention resides in the novel features of the original concept and design, the construction and arrangement of elements, and the installation procedures of the reinforced supporting bar—presently described in detail and apparent in the accompanying drawings and indicated in the appended claims.

BRIEF DESCRIPTION OF THE DRAWINGS

The drawings disclose a device designed to carry out the various objects of the invention.

FIG. 1, a perspective view of a section of a roof, shows the new reinforced gutter-hanger supporting bar with the novel LOCK-IN embodiment of the invention, as typically installed.

FIG. 2A is a plan view of the metal blank with only the holes punched.

FIG. 2B is a plan view of the completed reinforced supporting bar.

FIG. 2C is a cross-section elevation along line X—X of FIG. 2B.

FIG. 2D, a portion of an enlarged perspective view of the reinforced supporting bar, shows construction details.

FIGS. 3A, 3B, 3C are detailed cross-section views showing progressively, the novel installation procedures for the invention.

FIG. 4A, an enlarged cross-section along line 0—0 of FIG. 1, shows a complete installation with an "Ogee" gutter.

FIG. 4B, a similar cross-section, shows the easy adaptation to a "½-Round" gutter or any other style gutter.

PREFERRED EMBODIMENT OF THE INVENTION

This invention concerns a new, reinforced supporting bar with the novel LOCK-IN feature, specifically designed to improve the performance of conventional spike and tube hangers by permanently eliminating the serious fault of these hanges—loosensed and lost spikes.

The principal and preferred embodiment of the invention is the LOCK-IN feature of the reinforced supporting bar. This is formed through a combination of novel, ancillary embodiments, previously described and illustrated: (1) Embodiments resident in the original concept and design. (2) Important embodiments in the construction elements and punch and die work of the reinforced supporting bar. (3) Final embodiments resident in the installation procedures incorporating the reinforced supporting bar with the spike and tube hanger in conjunction with any eaves-hung metal gutter to create the novel LOCK-IN preferred embodiment of the invention.

BEST MODE OF THE INVENTION

In accordance with the embodiments of the invention, the reinforced gutter-hanger supporting bar is a stamped, one-piece metal strip, preferably from heavy sheet metal. It is modified by punch and die work into three contiguous, yet different sections, each with a specific function: First, a short flat end section provided with two transverse deep score marks and two 3° bends coinciding with and superimposed on the score marks. These score marks and bends facilitate bending the bar by hand manipulation during installation. One hole centered near the end of the bar is for the spike of the spike and tube hanger to pass through. Second, a rigid rib-reinforced intermediate section, spans the gutter trough and adds truss-like strength to the spike and tube hanger and the gutter. Third, a longer flat terminal section engages the roof and has nail holes centered along the axis for fastening to the roof with several nails.

During installation the existing spike of the spike and tube hanger is inserted through the hole provided in the reinforced supporting bar. Then, with said bar hanging freely on the spike (as herein described), the gutter and the spike and tube hanger are fastened together to the facia board in the manner customarily used in the art. Next, with the spike driven all the way in, the reinforced supporting bar, still suspended on the spike, is bent using hand manipulation, upward and over the spikehead and gutter flange to LOCK-IN the spike. Now, the intermediate rib-reinforced section spans the gutter trough and the long, flat terminal section engages the roof to which it is fastened with several nails. This permanently secures the spike by completing the novel LOCK-IN embodiment of the invention.

But the invention will be better understood by referring to the detailed descriptions and the following explanations of the drawings, wherein like numerals designate corresponding parts of various views.

FIG. 1 is a perspective view of a section of a roof structure. It clearly illustrates the object and use of the reinforced supporting bar to correct the serious fault of spike and tube hangers—loosened and even lost spikes. A section of "Ogee" gutter is shown typically supported by embodiments of the invention, wherein the spike and tube hanger is incorporated and installed with the new reinforced supporting bar. This creates the novel LOCK-IN preferred embodiment of the invention. Also, well illustrated, is the automatic adjustment of the reinforced supporting bar to the pitch of the gutter, during installation.

#1 indicates the new reinforced gutter-hanger supporting bar as typically installed. #2 shows the novel LOCK-IN embodiment of the invention in place. #3 indicates the rigid, rib-reinforced truss-like section of the bar which spans the gutter trough. #4 indicates the flange of the gutter. #5 indicates the tube of the spike and tube hanger. #7 indicates the rear wall of the gutter. #8 indicates the roof rafter. #9 indicates the roof sheathing. #10 is the facia board. #15 is the top rear edge of the gutter. It shows, exagerated for emphasis, the pitch line of the gutter. #13 indicates the "Ogee" style gutter. #11 indicates one of several nails securing the reinforced supporting bar to the roof. #0-0 indicates the center line of the bar for the cross-section FIG. 4A.

FIGS. 2A to 2D show four detailed views of the novel design and construction embodiments of the invention.

FIG. 2A is a plan view of the strip metal blank with only the holes punched.

FIG. 2B is a plan view of the completed reinforced gutter-hanger supporting bar. #12 of this view indictes the novel score mark and bends that form the LOCK-IN embodiment. #3 imdicates the rib-reinforced section of the bar that spans the gutter trough.

FIG. 2C is a cross-section elevation view on a plane along line #X-X of FIG. 2B.

FIG. 2D is a part of an enlarged perspective view of the reinforced supporting bar, emphasizing at #12, the novel construction embodiments comprised of several transverse, deep score marks with superimposed 3° bends. #3 is the rib-reinforced gutter-spanning section of the bar.

FIGS. 3A, 3B, 3C present three fragmentary elevation views. In progressive steps, they graphically illustrate the novel installation embodiments of the invention—which incorporate the reinforced supporting bar with the spike and tube hanger to create the LOCK-IN preferred embodiment of the invention.

FIG. 3A shows spike #6, inserted through the one hole in the terminal end of the reinforced supporting bar. Next, driven serially, through the front wall of the gutter flange #4; then, through tube #5, of the spike and tube hanger; through the real wall #7 of the gutter; through the facia board #10, and part way into rafter #8. The reinforced supporting bar #1 now hangs down on spike #6.

FIG. 3B shows spike #6, now driven all the way in, securing the gutter flange #4, the spike and tube hanger #5-#6, and the rear wall #7 of the gutter to the facia board #10. The end of the supporting bar #1 is held firmly against the front of flange #4 by the spikehead. By hand manipulation, bar #1 is bent sharply upward at the first score mark and 3° bend, over the spikehead and held tightly against it. This practically completes the novel LOCK-IN embodiment at #2. The bar #1 now points up and leans slightly toward the roof #9.

FIG. 3C shows the reinforced supporting bar #1 bend downward toward the roof #9, at the second score mark and 3° bend, then bent over the top of the gutter flange and spikehead to LOCK-IN the spike. The bar #1 then spans the gutter trough with rib-reinforced section #3, and engages the roof sheathing #9, to which it is secured by several nails #11. This completes the installation embodiments and creates the novel LOCK-IN preferred embodiment #2 of the invention.

FIG. 4A is a larger cross-section view along line #0-0 of FIG. 1. It shows the reinforced supporting bar #1 in position as incorporated and installed with the spike and tube hanger #5-#6 and gutter flange #4, on a standard "Ogee" gutter #13. It clearly discloses the novel LOCK-IN preferred embodiment of the invention at #2.

FIG. 4B, a similar cross-section view, shows the easy adaptation for use with the "½-Round" gutter #14, or any other shape eaves-hung metal gutter.

The drawings also disclose the three strong gutter support points provided by the invention: First, the rear wall #1 of the gutter is secured to the facia board #10, by the spike and tube hanger #5-#6; Second, the front of the gutter flange #4 and the gutter #13 are supported where most needed by both the spike and tube hanger #5-#6, and the LOCK-IN embodiment #2 of the reinforced supporting bar #1; Third, the entire gutter attachment is secured by nailing the supporting bar #1 to the roof with several nails, #11.

The reinforced gutter hanger supporting bar with its novel LOCK-IN embodiment of the invention provides a superior gutter hanger attachment, when incorporated with the universal spike and tube hanger and used with any eaves-hung metal gutter. Simple, strong, inexpensive and expeditious to make, it is the easiest to install gutter-hanger supporter available to the art today.

DETAILED DESCRIPTION PROCEDURES

Before proceeding with the installation of the reinforced supporting bar, it is required to partially hang the gutter in the following manner as practiced in the art: First, provide a predetermined chalk line on the facia board indicating the desired pitch of the gutter; Second, align the top edge of the rear gutter wall with this line and secure the rear gutter wall to the facia board with suitable nails; Third, locate points along the gutter flange at which to install the spike and tube hangers incorporated with the reinforced supporting bar. Space these points at intervals to coincide with rafter ends behind the facia board, by means as practiced in the art. This assures solid nailing for the spikes.

The detailed procedures which automatically create the novel LOCK-IN preferred embodiment of the invention (refer to FIGS. 3A, 3B, 3C) follow:

Hold the reinforced supporting bar with the scored and bent end section up; the raised reinforcing rib of the intermediate section toward the gutter, and the long flat roof engaging section down and slanting out toward you. Insert the long, sharp spike of the spike and tube hanger through the one hole in the scored and bent (now upper) end section of the reinforced supporting bar. With the bar hanging freely on the spike, proceed to drive the spike through the front wall of the gutter-flange, which is now backed up by the tube of the spike and tube hanger inserted between the inside of the flange and the rear gutter wall, then through the tube. While keeping the tube and spike aligned at 90° to the rear gutter wall and on the same parallel plane as the gutter bottom, drive the spike on through the rear gutter wall, the facia board and into the end of the roof rafter. The spike now secures the spike and tube hanger and the rear gutter wall to the facia board. The spikehead holds the reinforced supporting bar against the outside wall of the gutter flange. The bar still hangs down, slanting out toward you.

Using hand manipulation, bend the bar sharply upward at the 1st score mark and 3° bend, up and over the spikehead. Strike the bar a solid hammer blow to set it tightly against the spikehead. The reinforced supporting bar now points up and leans slightly in toward the roof.

Again, with hand manipulation, bend the bar at the 2nd score mark, sharply downward toward the roof, across the spikehead and top of gutter flange. A downward hammer blow on this scoremark sets the bar securely over the gutter flange and spikehead to LOCK-IN the spike.

The rigid, rib-reinforced intermediate section of the bar now spans the gutter trough and the long terminal section of the bar engages the roof.

Complete the installation by driving several nails through appropriate holes in the terminal roof-engaging section, into the roof sheating and the rafter. Only these nails and the existing spike of the spike and tube hanger are required to fasten the device to the facia board and roof.

In summation: The novel design, construction and installation of the reinforced gutter hanger supporting bar are all embodiments of the invention. When combined and incorporated with the conventional spike and tube hanger, in conjunction with any eaves-hung metal gutter, they create the novel LOCK-IN preferred embodiment of the invention, as herein disclosed. The result is a superior gutter-hanger supporter, inexpensive and easy to install.

It is claimed:

1. In a gutter hanging system including a tube extending between the front and rear walls of a gutter and a spike having a head thereon; said spike passing through the front wall of the gutter, through said tube and said rear wall and into the facia of a building to support said gutter thereon; and a metal strap having an opening adjacent the first end thereof which end is located adjacent the front wall of said gutter, said spike passing through said opening, said strap extending toward the roof of said building and having its second end secured to said roof; the improvement wherein the first end of said strap is located between the head of said spike and the outside of the front wall of said gutter and wherein said strap is bent at an angle of approximately 180° at a point near said opening but on the side of said opening away from said first end so that a portion of said strap after the bend overlies the head of said spike to lock the same in place.

2. The improvement as set forth in claim 1 wherein said strap includes a plurality of holes in the second end thereof for securing the same to said roof with the use of nails.

3. The improvement as set forth in claim 1 wherein said strap includes a rib-reinforced intermediate section which overlies only said gutter when the strap is in place.

* * * * *